US006450266B1

(12) United States Patent
Pahila

(10) Patent No.: US 6,450,266 B1
(45) Date of Patent: Sep. 17, 2002

(54) SPRINKLER ARRANGEMENT FOR DOCUMENT STORAGE

(75) Inventor: Oliver S. Pahila, Mount Vernon, NY (US)

(73) Assignee: The Reliable Automatic Sprinkler Co., Inc., Mount Vernon, NY (US)

( * ) Notice: Subject to any disclaimer, the term of this patent is extended or adjusted under 35 U.S.C. 154(b) by 0 days.

(21) Appl. No.: 09/768,325

(22) Filed: Jan. 24, 2001

(51) Int. Cl.[7] ..... A62C 37/08; B05B 1/26

(52) U.S. Cl. ..... 169/37; 169/41; 169/57; 239/498; 239/500; 239/504; 239/522; 239/524; 239/555

(58) Field of Search ..... 169/37, 41, 57; 239/498, 504, 518, 521, 522, 554, 524, 555, 500

(56) References Cited

U.S. PATENT DOCUMENTS 1,515,766 A * 11/1924 Astren ..... 239/555
2,724,614 A * 11/1955 Rider
3,802,512 A * 4/1974 Todtenkopf
4,113,021 A * 9/1978 Werner ..... 169/37
4,553,603 A * 11/1985 Dwyer ..... 169/37
4,700,894 A * 10/1987 Grzych ..... 239/555
5,839,667 A * 11/1998 Fishcer
5,924,492 A * 7/1999 Kikuchi et al.

* cited by examiner

*Primary Examiner*—Steven J. Ganey
(74) *Attorney, Agent, or Firm*—Baker Botts, LLP

(57) ABSTRACT

In the typical embodiments described in the specification, a sprinkler arrangement for protecting stored documents has a sprinkler body with an orifice providing a K factor in the range from about 1.1 to about 2.7, a pair of frame arms terminating in a boss from which a glass bulb supports a cap in position to seal the orifice in the passage, and a pair of closely spaced substantially planar deflector members having a peripheral edge spacing in a range from about 0.01 inch to about 0.60 inch. The deflector member closer to the axial passage has a plurality of slots permitting some water to pass into the space between the deflector members where it generates a very fine droplet mist and some water to be distributed outwardly in the form of fine droplets to carry the mist away from the sprinkler. A recess formed in the surface of the second deflector member facing the first deflector member provides a cavity which promotes atomization and generates turbulence.

32 Claims, 3 Drawing Sheets

SPRINKLER ARRANGEMENT FOR DOCUMENT STORAGE

BACKGROUND OF THE INVENTION

This invention relates to sprinkler arrangements which are effective to protect stored documents while applying substantially lower volumes of water than conventional sprinkler arrangements.

Stored records such as libraries and archives containing paper documents and compilations contain valuable information which should be protected from damage by water to the extent possible while still assuring protection against fire damage. Many conventional fire protection arrangements for stored documents tend to apply excessive volumes of water which, while suppressing fire damage, results in significant water damage. While attempts have been made to control or reduce such water damage by generating a mist to control a fire, the very fine droplets constituting the mist produce a fog-like atmosphere which is not easily projected away from the mist generating nozzle and is often carried away from the fire by the fire plume before it can reach the location of the fire.

The Fishcer U.S. Pat. No. 5,839,667 discloses a water mist nozzle arrangement having a diffuser formed with tines which are bent away from the sprinkler body and are separated by channels formed in the surface of the diffuser facing the sprinkler body in which the sprinkler body has an orifice providing a K-factor in the range from about 0.1 to a maximum of 1.0.

SUMMARY OF THE INVENTION

Accordingly, it is an object of the present invention to provide a sprinkler arrangement for protecting stored documents which overcomes disadvantages of the prior art.

Another object of the invention is to provide a sprinkler arrangement which requires substantially less water than conventional sprinklers while effectively projecting a fire-smothering mist toward the location of a fire.

These and other objects of the invention are attained by providing a sprinkler arrangement which includes a sprinkler body with an axial passage for water and a deflector assembly positioned in spaced relation to the sprinkler body passage having two closely spaced substantially planar deflector members extending substantially perpendicular the axis of the passage. The deflector member closest to the sprinkler body passage has a plurality of openings to permit water to enter the space between the deflector members from which it is distributed in the form of a mist of very fine droplets while also distributing some of the impinging water in the form of larger fine droplets which are capable of penetrating the fire plume and carrying the mist toward the fire.

In a preferred embodiment the spacing between the peripheral edges of the two deflector members is in a range from about 0.001 inch to about 0.060 inch, preferably from about 0.020 inch to about 0.040 inch, and desirably about 0.030 inch. In this embodiment, the first deflector member has a plurality of radial slots extending inwardly from the outer periphery and the second deflector member has a recess in the surface facing the slots which tapers in the radially outward direction toward the space between the peripheral edges of the two deflector members. If desired, the second deflector member may also have a plurality of slots to permit larger fine droplets to emerge and carry very fine droplet mist generally in the axial direction of the sprinkler.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENTS

Figure 1:
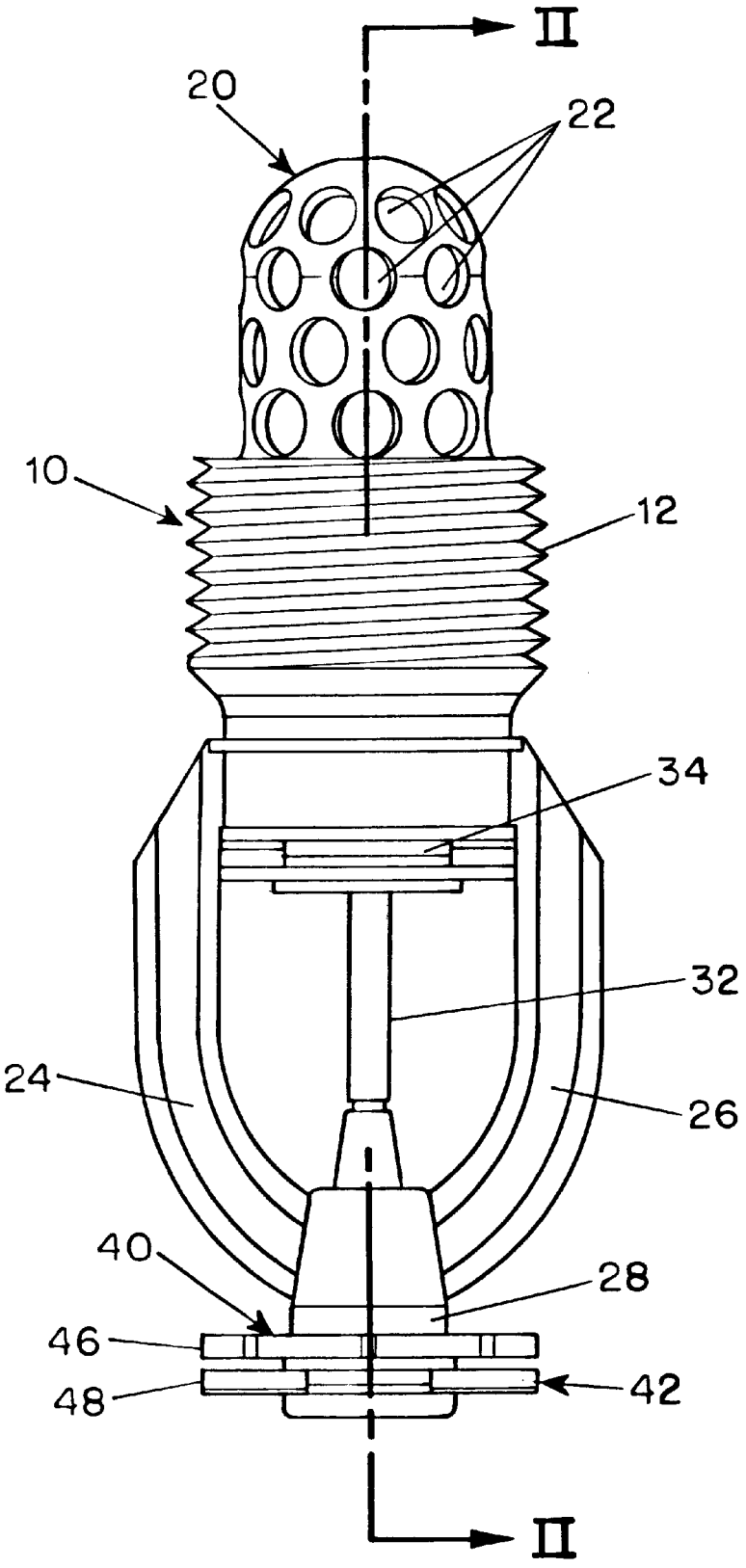
FIG. 1 is a side view illustrating a representative embodiment of a sprinkler arrangement according to the invention.

In the typical embodiment of the invention shown in the drawings, a sprinkler arrangement 10 has a threaded body 12 arranged to be connected to a water supply pipe and having an axial passage 14 terminating in an orifice 16 sized to provide a desired rate of water flow through the passage, which is dependent upon the pressure of the water supplied to the passage. In accordance with the invention, the orifice 16 has a diameter in the range of about 3/16 to 6/16 inch, providing a K-factor for the sprinkler in a range from 1.1 to about 2.7, thereby assuring sufficient water flow at pressures as low as 3.5 bar (50 psi) to generate both a very fine droplet mist and a stream of fine droplets to convey the mist toward a fire. At the inlet end of the passage 14 a hemispherical screen 20 is provided with openings 22 which are small enough to prevent passage of any particles having a size large enough to block the orifice 16.

Figure 2:
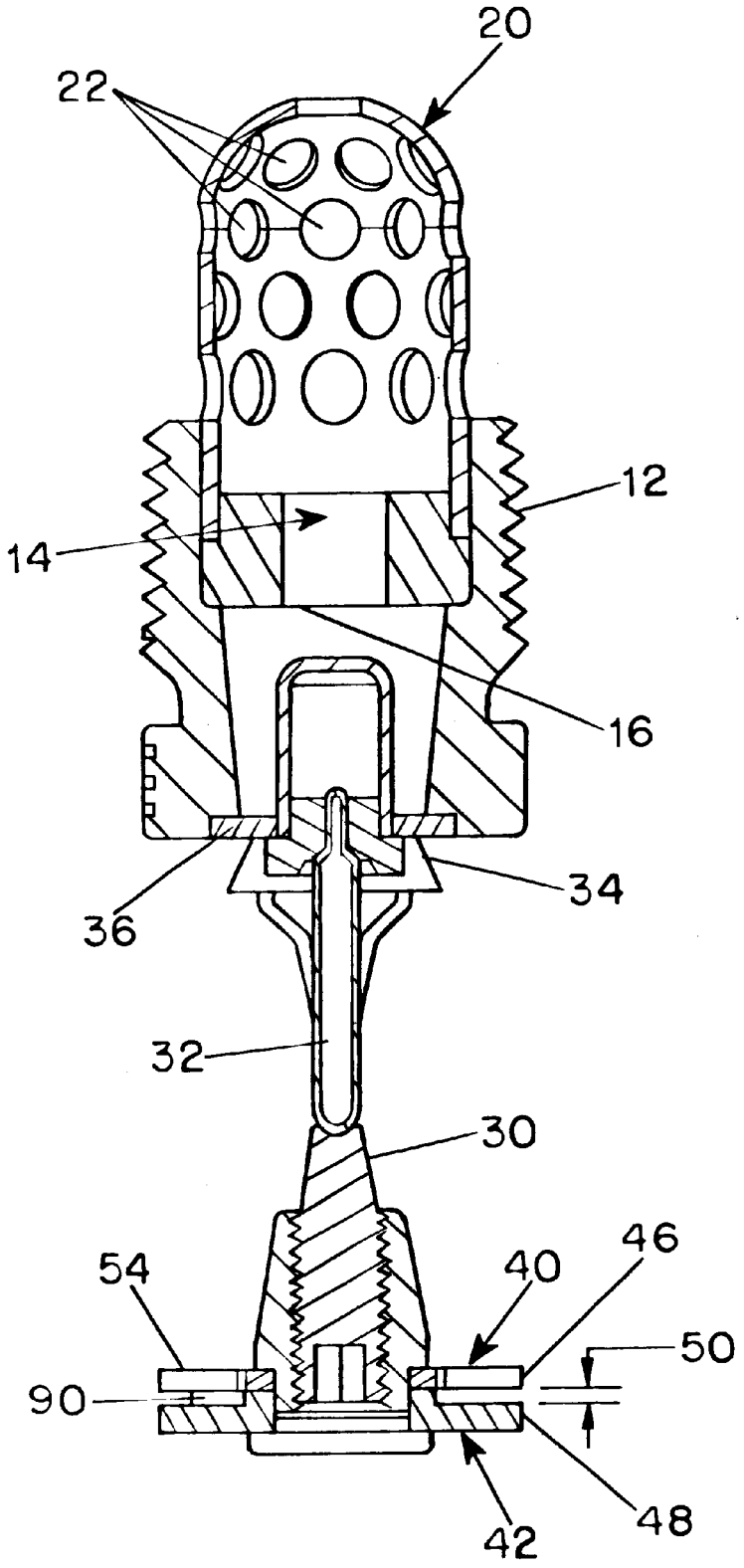
FIG. 2 is a view in longitudinal section taken along the line II—II in FIG. 1 and looking in the direction of the arrows.

As shown in FIGS. 1 and 2, the sprinkler 10 has a pair of frame arms 24 and 26 projecting forwardly from the sprinkler body 12 and joined at a boss 28 containing an adjusting screw 30, and a glass bulb 32 extends between the adjusting screw 30 and a cup shaped cap 34 received in a washer 36 so as to normally seal the orifice 16 and prevent water from leaving the passage 14. The glass bulb 32 preferably is a 2.5 mm diameter bulb providing a faster response time than conventional 3 mm diameter bulbs in order to expedite generation of a fire smothering mist when heat from a fire reaches the sprinkler arrangement 10. Response time is sometimes given in terms of the response time index, which is equal to the thermal time constant in seconds of the thermally responsive element multiplied by the square root of the velocity, in meters per second, of the hot gas passing the thermally repressive element. Preferably, the glass bulb 32 has a release temperature of about 150° F.–160° F. and a response time index less than 34 $m^{1/2}sec^{1/2}$, desirably about 23 m $sec^{1/2}$ to 33 $m^{1/2}sec^{1/2}$.

Mounted on the boss 28 are two generally planar deflector members 40 and 42 which extend substantially perpendicular to the sprinkler axis 44 and are positioned with their peripheral edges 46 and 48 disposed in closely spaced relation. In the illustrated embodiment the edges 46 and 48 are separated by a gap 50 which has a dimension in the range from about 0.001 inch to 0.060 inch, preferably about 0.020 inch to 0.040 inch and desirably about 0.030 inch.

Figure 3:
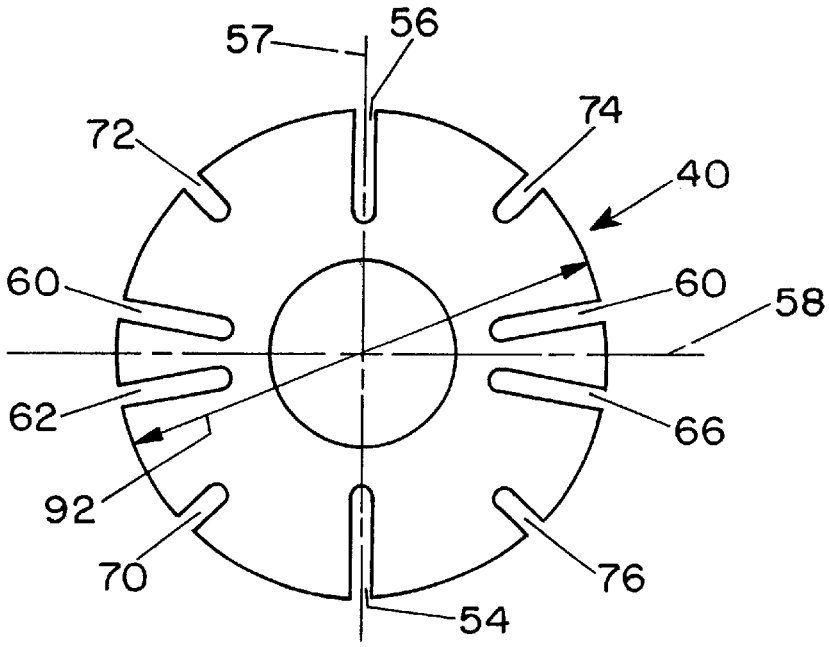
FIG. 3 is a plan view illustrating a representative embodiment of a first deflector member for use in the sprinkler arrangement of FIGS. 1 and 2.

As shown in FIG. 3, the first deflector member, i.e., the deflector member 40 which is closer to the orifice 16, is formed with a plurality of radial slots. Two of the radial slots 54 and 56 are diametrically opposed and positioned in a plane 57 which is perpendicular to the plane 58 of the frame arms 24 and 26 and four slots 60, 62, 64, and 66 are disposed at angles of about 5° to 15°, preferably about 10°, from the plane 58 of the frame arms on opposite sides of that plane and on diametrically opposite sides of the deflector member. Four more slots 70, 72, 74 and 76, which are shorter than the other slots, are located at 45° from the plane of the frame arms on opposite sides of that plane and diametrically opposite each other.

Figure 4:
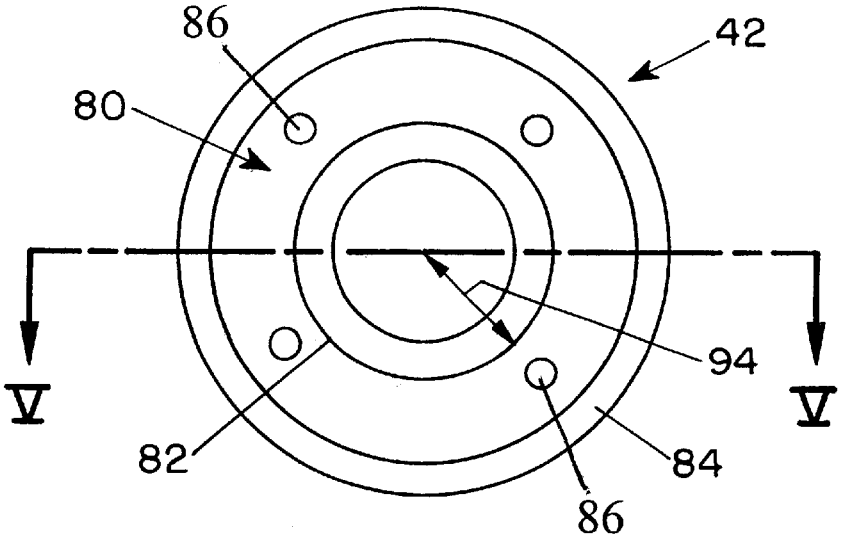
FIG. 4 is a plan view illustrating a representative embodiment of a second deflector member for use in the sprinkler arrangement of FIGS. 1 and 2.
Figure 5:
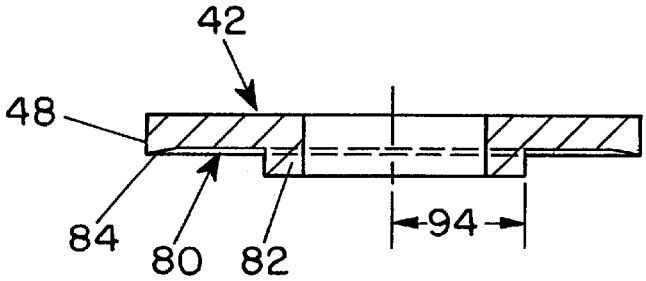
FIG. 5 is a cross-sectional view of the second deflector member taken along the line V—V of FIG. 4 and looking in the direction of the arrows.

As shown in the plan view of FIG. 4, the second deflector member 42 is formed with an annular recess 80 surrounding a central portion 82 and a beveled lip 84 surrounding the recess which is inclined at an angle of about 1° to 20°, preferably 5° to 15°, desirably 10°, outwardly from the recess to the peripheral edge 48 of the second deflector member.

With this arrangement, water emerging from the orifice 16 in the sprinkler body passage 14 is distributed by the boss 28 against the surface of the first deflector member 40 and some of the water passes through the slots 54–76 in the first deflector member into a chamber 90 formed between the first and second deflector members where it is atomized by turbulence to form a mist of very fine droplets. The beveled peripheral lip 84 of the second deflector member allows the atomized water mist to merge with fine droplets of larger size which are distributed outwardly by the first deflector member. This produces more atomized water mist and creates a swirling motion that throws the fine droplets and very fine droplet mist farther away from the nozzle with sufficient momentum to pass through a fire plume toward a fire and also project the mist outwardly so as to protect a larger area. The very fine droplet spray reduces oxygen levels as the water vaporizes and displaces oxygen, thereby tending to smother the fire and also prevents heat transfer by radiation from a fire to other parts of the protected area and moistens adjacent combustible documents to protect them without soaking them.

In a preferred embodiment of the invention, both the deflector members 40 and 42 have a diameter of about 0.7 to 0.9 inch, preferably about 0.8 inch, the longer slots 54–66 in the first deflector member 40 have a length of about 0.17 inch to 0.21 inch, preferably about 0.19 inch, and the shorter slots 70–76 have a length of about 0.07 inch to 0.11 inch, preferably about 0.09 inch. In the second deflector member 42 the central portion 82, which forms a spacer between the deflectors, has a diameter of about 0.19 inch to about 0.23 inch, preferably about 0.21 inch, and the radial length of the lip 82 is about 0.04 inch to about 0.07 inch, preferably about 0.055 inch while the depth of the recess 80 is about 0.008 inch to about 0.012 inch, preferably about 0.01 inch. The longer slots 54–66 in the first deflector member 40 preferably have a root diameter which is the same as that of the central portion 82 leaving no space to allow formation of a partial vacuum.

If desired, the second deflector member 42 may also have through passages 86 such as holes or slots to permit fine water droplets to carry the very fine droplet mist generated between the deflector members in a direction substantially parallel to the axis of the sprinkler.

Sprinkler arrangements according to the invention can be installed at ceiling heights up to 13 feet and are effective at pressures as low as 3.5 bar (50 psi). With the high K factor of up to 2.7 and the low operating pressure many of the droplets that are generated tend to coalesce and become too large to vaporize readily and they can extract heat from a fire by cooling as well as reducing oxygen levels near the seat of the fire.

Although the invention has been described herein with reference to specific embodiments many modifications and variations therein will readily occur to those skilled in the art. Accordingly, all such variations and modifications are included within the intended scope of the invention.

I claim:

1. A sprinkler arrangement comprising:

a sprinkler body having an axial passage for delivery of water;

a pair of arms extending from the sprinkler body in a plane generally parallel to the sprinkler axis;

a first substantially planar deflector member supported by the pair of arms generally in a plane perpendicular to the axis of the sprinkler body and having a plurality of angularly distributed slots; and a second substantially planar deflector member supported in closely spaced relation to the first deflector member on the side opposite from the axial passage and generally in a plane perpendicular to the axis of the sprinkler body.

2. A sprinkler arrangement according to claim 1 wherein the axial passage has an orifice providing a K-factor in the range from about 1.1 to about 2.7.

3. A sprinkler arrangement according to claim 2 wherein the axial passage has an orifice providing a K-factor in the range from about 1.1 to 1.5.

4. A sprinkler arrangement according to claim 3 wherein the axial passage has an orifice providing a K-factor of about 1.1.

5. A sprinkler arrangement according to claim 2 wherein the axial passage has an orifice providing a K-factor of about 2.7.

6. A sprinkler arrangement according to claim 1 wherein the first and second deflector members have adjacent peripheral edges which are separated from each other by a spacing in the range from about 0.001 inch to about 0.06 inch.

7. A sprinkler arrangement according to claim 6 wherein the first and second deflector members have adjacent peripheral edges which are separated from each other by a spacing in the range from about 0.02 inch to about 0.04 inch.

8. A sprinkler arrangement according to claim 7 wherein the first and second deflector members have adjacent peripheral edges which are separated from each other by a spacing of about 0.03 inch.

9. A sprinkler arrangement according to claim 1 wherein the first deflector member has a first set of substantially radially slots extending in a plane substantially perpendicular to a plane containing the frame arms and located on diametrically opposite sides of the sprinkler axis and a second set of slots each being spaced at an angle of about 15° to 30° from the plane of the frame arms on each side of the axis of the sprinkler.

10. A sprinkler arrangement according to claim 9 wherein the slots of the second set each extend at an angle of about 20° from the plane of the frame arms.

11. A sprinkler arrangement according to claim 9 wherein the slots of the first and second sets all have substantially the same length.

12. A sprinkler arrangement according to claim 11 including a spacer between the first and second deflector members which has a diameter substantially the same as the root diameter of the slots of the first and second sets.

13. A sprinkler arrangement according to claim 9 wherein the first deflector member has a third set of slots each extending at an angle in the range from about 40° to about 50° from the plane of the frame arms.

14. A sprinkler arrangement according to claim 13 wherein the slots of the third set extend at angles of about 45° from the plane of the frame arms.

15. A sprinkler arrangement according to claim 13 wherein the slots of the third set are shorter than the slots of each of the first and second sets.

16. A sprinkler arrangement according to claim 13 wherein the slots of the first and second sets have substantially the same length and the slots of the third set are approximately half the length of the slots of the first and second sets.

17. A sprinkler arrangement according to claim 1 wherein the second deflector member is imperforate.

18. A sprinkler arrangement according to claim 1 wherein the second deflector member has a plurality of apertures.

19. A sprinkler arrangement according to claim 1 wherein the side of the second deflector member facing the first deflector member has an annular recess with an inner radius.

20. A sprinkler arrangement according to claim 19 wherein the first deflector member has a plurality of slots extending inwardly from the periphery substantially as far as the inner radius of the annular recess in the second deflector member.

21. A sprinkler arrangement according to claim 19 wherein the annular recess has an outer lip which extends at a bevel angle in the direction toward the first deflector member.

22. A sprinkler arrangement according to claim 21 wherein the bevel angle of the outer lip is in the range from about 1° to 20°.

23. A sprinkler arrangement according to claim 22 wherein the bevel angle of the outer lip is in the range from about 5° to about 15°.

24. A sprinkler arrangement according to claim 23 wherein the bevel angle of the outer lip is about 10°.

25. A sprinkler arrangement according to claim 19 wherein the annular recess has a depth of about 0.008 to about 0.012 inch.

26. A sprinkler arrangement according to claim 25 wherein the annular recess has a depth of about 0.01 inch.

27. A sprinkler arrangement according to claim 19 wherein the inner radius of the annular recess is about 0.19 inch to about 0.23 inch.

28. A sprinkler arrangement according to claim 27 wherein the inner radius of the annular recess is about 0.21 inch.

29. A sprinkler arrangement according to claim 1 including a cap normally sealing the end of the axial passage facing the first deflector member, and a thermally responsive element normally retaining the cap in sealing position.

30. A sprinkler arrangement according to claim 29 wherein the thermally responsive element is a glass bulb.

31. A sprinkler arrangement according to claim 30 wherein the glass bulb provides a response time index of less than about 34 $m^{1/2}sec^{1/2}$.

32. A sprinkler arrangement according to claim 30 wherein the glass bulb provides a response time index in the range from about 23 $m^{1/2}sec^{1/2}$ to about 33 $m^{1/2}sec^{1/2}$.

* * * * *